US006995977B2

(12) United States Patent
Yang

(10) Patent No.: US 6,995,977 B2
(45) Date of Patent: Feb. 7, 2006

(54) STRAP BUCKLE APPARATUS FOR A NOTEBOOK COMPUTER

(75) Inventor: Kuo-Chang Yang, Hsinchu (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 266 days.

(21) Appl. No.: 10/658,389

(22) Filed: Sep. 10, 2003

(65) Prior Publication Data

US 2004/0190237 A1 Sep. 30, 2004

(30) Foreign Application Priority Data

Mar. 25, 2003 (TW) ..... 92204653 U

(51) Int. Cl.
*G06F 1/16* (2006.01)

(52) U.S. Cl. ..... 361/683; 361/679; 294/152; 248/188.1; 24/649

(58) Field of Classification Search ..... 361/679, 361/683, 600, 641; 294/152, 137, 165, 1.1, 294/27.1, 31.2, 138, 147–157; 70/14, 58, 70/168, 32, 33, 34, 57; 248/188.11, 188.41, 248/688; 224/614–616, 930, 257, 666, 108.43, 224/929, 584, 576, 578; 24/649, 650, 599, 24/591, 301, 302, 265 WS, 265 BC
See application file for complete search history.

(56) References Cited

U.S. PATENT DOCUMENTS

| | | | | |
|---|---|---|---|---|
| 5,913,907 | A * | 6/1999 | Lee | 70/58 |
| 5,960,651 | A * | 10/1999 | Tanisawa | 70/14 |
| 6,032,339 | A * | 3/2000 | D'Addario | 24/649 |
| 6,109,678 | A * | 8/2000 | Esfandiari et al. | 294/152 |
| 6,163,450 | A * | 12/2000 | Kim | 361/679 |
| 6,389,853 | B1 * | 5/2002 | Pate et al. | 70/18 |
| 6,726,071 | B2 * | 4/2004 | Baseflug et al. | 224/258 |
| 6,883,694 | B2 * | 4/2005 | Abelow | 224/666 |

FOREIGN PATENT DOCUMENTS

JP 02002149264 A * 5/2002

* cited by examiner

*Primary Examiner*—Michael Datskovskiy
(74) *Attorney, Agent, or Firm*—Rabin & Berdo, PC

(57) ABSTRACT

A strap buckle apparatus fastened to a lock hole is employed to connect to a strap. The strap buckle apparatus comprises a rotation hub, a base, and a rotation plug. The rotation hub controls the rotation angle of the rotation plug. The base with a hole in the center connects to a strap. One end of the rotation plug is inserted into the lock hole, while the other end is fixed to the rotation hub.

11 Claims, 4 Drawing Sheets

STRAP BUCKLE APPARATUS FOR A NOTEBOOK COMPUTER

BACKGROUND OF THE INVENTION

1. Field of Invention

The present invention relates to a strap buckle apparatus, particularly for use with a laptop or a notebook computer.

2. Description of Related Art

Portable computing systems evolved from desktop PCs into notebook PCs over a short period of time. Nowadays, the computing performance of notebook PCs are getting higher and users increasingly demand that they weigh lighter so that they could be conveniently carried everywhere. With the convenience of carrying and using a notebook computer, an office is no longer restricted to a certain place and work productivity improves largely.

In order to enable a notebook to be portable, an ultra-thin notebook computer is developed. A CD-ROM and Floppy disk is designed as an external module. If the ultra-thin notebook computer is carried out of the office, the ultra-thin notebook computer is lighter without the external module. Moreover, in order to reduce weight and improve dissipation performance, an outer case (or housing) of the ultra-thin notebook computer is made of aluminum and magnesium alloy.

In addition, more peripheral devices have been designed and devised for the portable notebook computer. For example, a bag carrying the portable notebook computer is made of anti-shock and water-resistant materials and equipped with small partitions for additional storage means.

Nevertheless, there is a growing need for more peripheral devices for the portable notebook computer.

SUMMARY OF THE INVENTION

It is an object of the present invention to provide a strap buckle apparatus for a notebook computer.

In accordance with the foregoing and other objectives of the present invention, a strap buckle apparatus fastened to lock hole is employed to connect to a strap. The strap buckle apparatus comprises a rotation hub, a base, and a rotation plug. The rotation hub functions to control the rotation angle of the rotation plug. The base with a hole in the center functions to connect to a strap. One end of the rotation plug is inserted into the lock hole while the other end is fixed to the rotation hub.

According to a preferred embodiment of present invention, the strap buckle apparatus further includes a protection pad to prevent from scratching the surface of an outer case of a notebook computer. In addition, an E-clip is employed to fix the rotation plug to the rotation hub. In order to make the strap buckle apparatus lock in the lock hole steadily, a position groove is provided in the base and two ends of the position groove are carved deeper. A position pin of the rotation hub can fit in the position groove. If the position pin moves into the deeper groove, the position pin is stuck in the deeper groove except manual rotation.

In addition, the lock hole can be any kind of burglarproof lock hole, such as Kensington Lock hole. The position groove design in the strap buckle apparatus allows the strap buckle apparatus to fix to the lock hole steadily.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
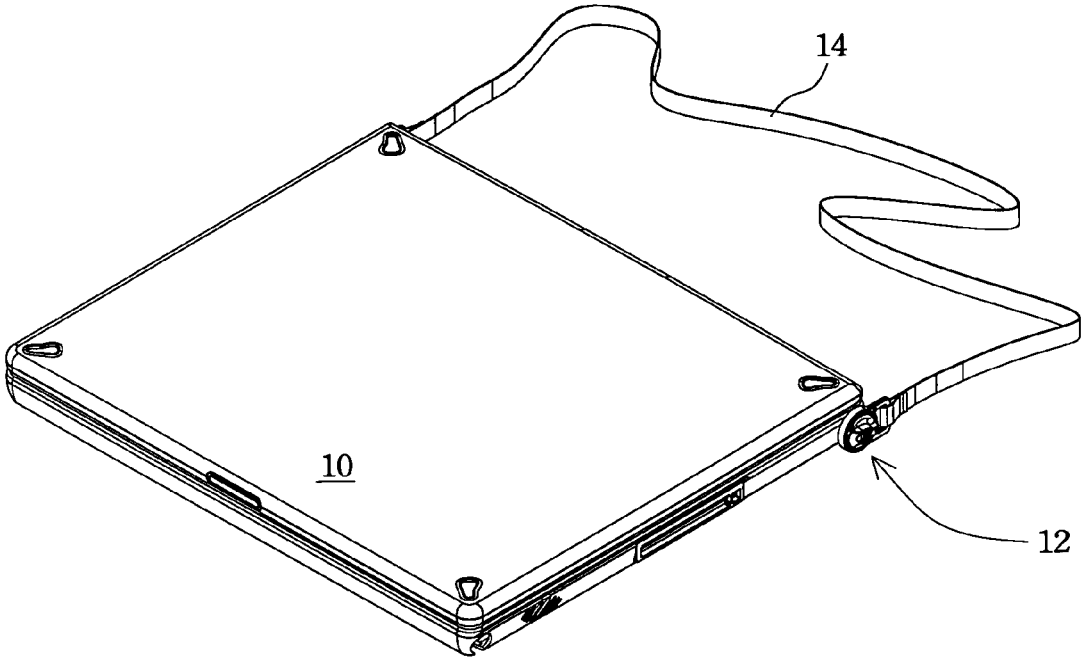
FIG. 1 illustrates a perspective view of a notebook computer with a strap buckle apparatus according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

The present invention is directed to a strap buckle apparatus for a notebook computer. The strap buckle apparatus links to an original lock hole (such as a Kensington Lock hole) and a strap. Therefore, the notebook computer is carried or supported by a strap, instead of a regular carry bag.

FIG. 1 illustrates a perspective view of a notebook computer with a strap buckle apparatus according to one preferred embodiment of this invention. A strap buckle apparatus 12 links to a notebook computer 10 and a strap 14. It is convenient to carry the notebook computer 10 by means of the strap 14.

Figure 1A:
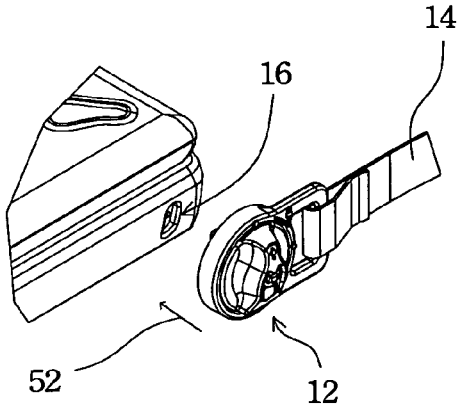
FIGS. 1A, and 1B illustrate steps of how a strap buckle apparatus attaches to a lock hole according to one preferred embodiment of this invention.
Figure 1B:
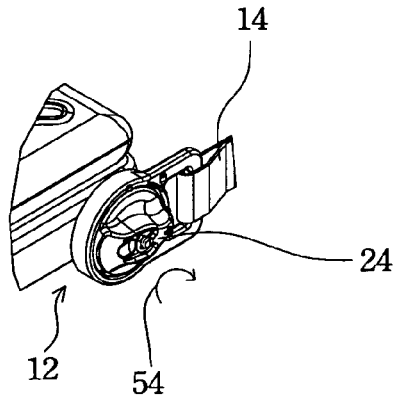

FIGS. 1A, and 1B illustrate steps of how a strap buckle apparatus attaches to a lock hole according to one preferred embodiment of this invention. Referring to FIG. 1A, a strap buckle apparatus 12 is inserted into a lock hole 16 along a direction 52 while the strap buckle apparatus 12 is not fixed to the lock hole 16. Referring to FIG. 1B, a rotation hub 24 of the strap buckle apparatus 12 needs to be rotated (along the direction 54) so as to fix the strap buckle apparatus 12 to the lock hole 16. The lock hole 16 can be any kind of burglarproof lock hole, such as Kensington lock hole.

Figure 1C:
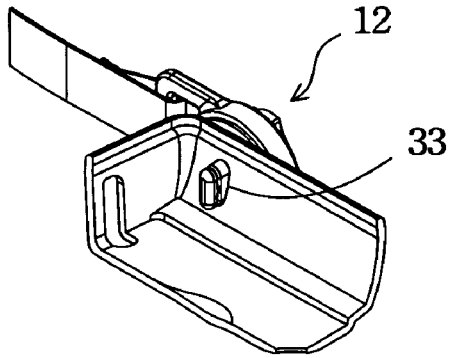
FIGS. 1C, and 1D illustrate perspective views of how a hook clamps a lock hole according to one preferred embodiment of this invention.
Figure 1D:
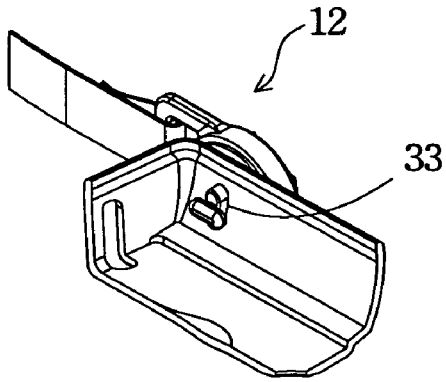

FIGS. 1C, and 1D illustrate perspective views of how a hook clamps a lock hole according to one preferred embodiment of this invention. Referring to FIG. 1C, a rotation plug 30 of a strap buckle apparatus 12 is inserted into a lock hole 16 while the strap buckle apparatus 12 is not fixed to the lock hole 16. The shape of the hook 33 is almost identical to the shape of the lock hole 16. If the rotation plug 33 is not rotated while it is inserted, the hook 33 will not clamp the lock hole 16.

Referring to FIG. 1D, a rotation plug 30 of a strap buckle apparatus 12 is inserted into a lock hole 16 and the hook 33 is rotated so as to clamp the lock hole 16. The hook 33 of a strap buckle apparatus 12 is rotated by a rotation hub 24 (illustrated in FIG. 1B). Thus, the plug 33 and the lock hole 16 are crossed so as to fix the plug 33 to the lock hole 16.

Figure 2:
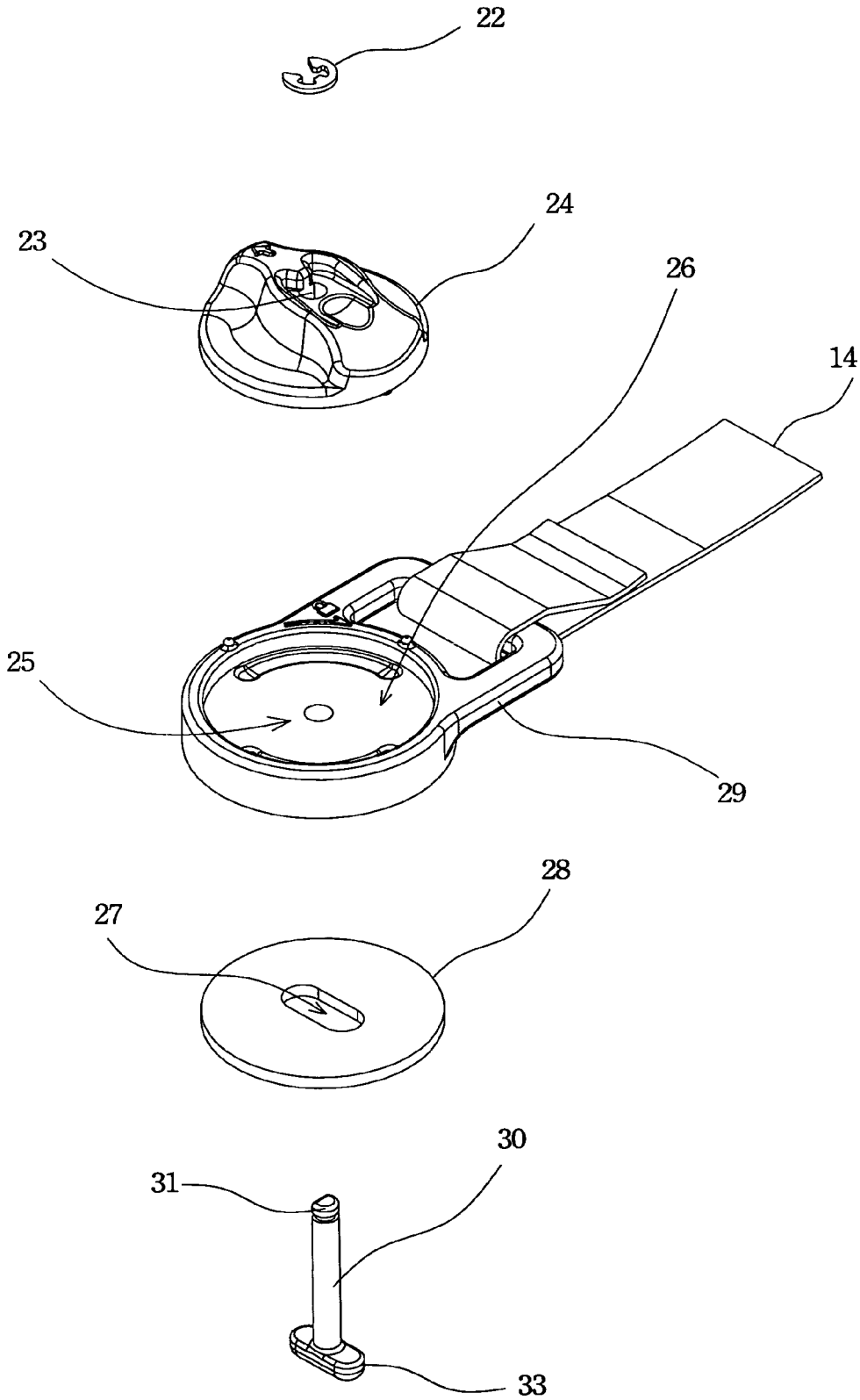
FIG. 2 illustrates an exploded view of a strap buckle apparatus according to one preferred embodiment of this invention.

FIG. 2 illustrates an exploded view of a strap buckle apparatus according to one preferred embodiment of this invention. The strap buckle apparatus includes a base 26, a rotation hub 24, a rotation plug 30, a protection pad 28 and an E-clip 22. A strap holder 29 on the edge of the base 26 connects to a strap 14. There is an opening 25 as an assembly hole on the center of the base 26. A protection pad 28 can be added between the base 26 and the outer case of a notebook computer so as to prevent from scratching the outer case. The protection pad 28 can be rubber pad. There is an opening 27 on the center of the protection pad 28 as an assembly hole.

Referring to FIG. 2 again, a rotation hub 24 is employed to control the hook 33's rotation direction and to decide whether a strap buckle apparatus 12 clamps the lock hole 16 or not. Because the hook 33 of the rotation plug 30 is employed to insert inside the lock hole 16, a shape of the hook 33 is almost identical to a shape of the lock hole 16. However, the shape of the hook 33 is smaller than that of the lock hole 16. The other end of the rotation plug 30 has a circular groove 31 for an E-clip 22 to attach to. When the strap buckle apparatus is assembled, the end with a circular groove 31 of the rotation plug 30 goes through three openings 27, 25 and 23. The E-clip 22 attaches to the circular groove 31 of the rotation plug 30. The rotation hub 24 and the rotation plug 30 can be fixed together. That is, the rotation hub 24 and the rotation plug 30 can rotate simultaneously in relation to the base 26.

Figure 3A:
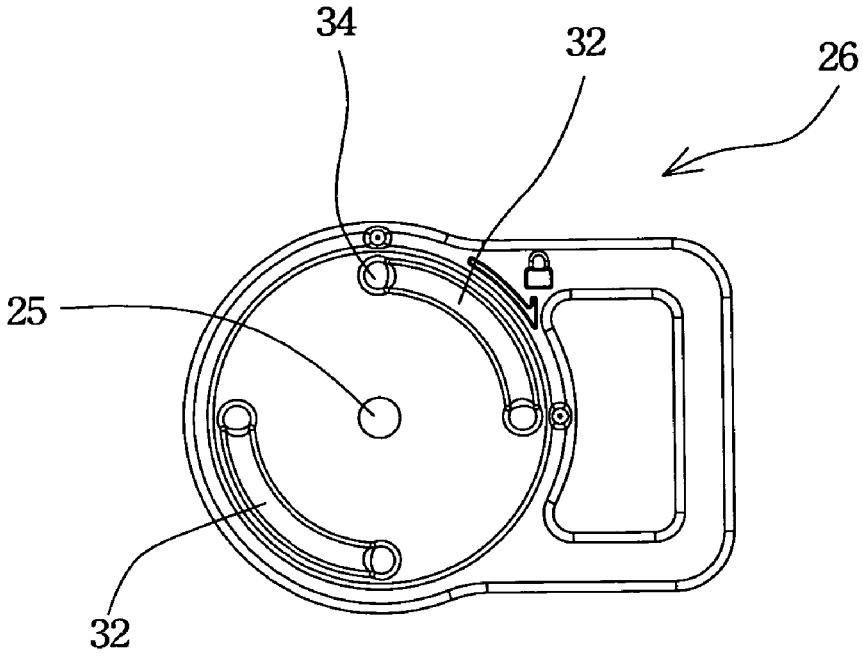
FIG. 3A illustrates a top view of a base of a strap buckle apparatus according to one preferred embodiment of this invention.
Figure 3B:
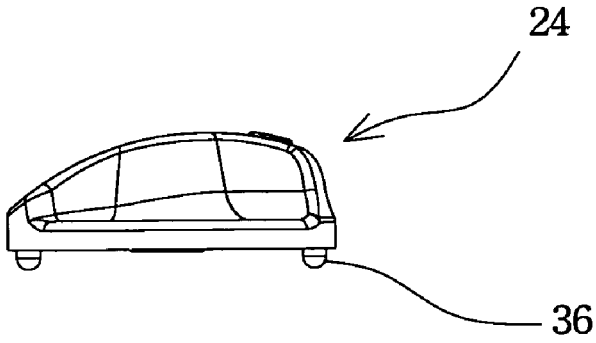
FIG. 3B illustrates a side view of a rotation hub of a strap buckle apparatus according to one preferred embodiment of this invention.

FIG. 3A illustrates a top view of a base of a strap buckle apparatus according to one preferred embodiment of this invention and FIG. 3B illustrates a side view of a rotation hub of a strap buckle apparatus according to one preferred embodiment of this invention. In order to make the strap buckle apparatus lock in the lock hole steadily, a position groove 32 is provided in the base and two ends of the position groove 32 are carved deeper (illustrated as a groove 34). A position pin 36 of the rotation hub 24 can fit in the position groove 32. If the position pin 36 moves into the groove 34, the position pin 36 will be stuck in the groove 34 except manual rotation.

According to a preferred embodiment of present invention, the strap buckle apparatus functions to support or carry a notebook computer. The lock hole can be any kind of burglarproof lock hole, such as Kensington Lock hole. The position groove design in the strap buckle apparatus allows the strap buckle apparatus fix to the lock hole steadily.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A strap buckle apparatus fastened to a lock hole of a notebook computer, said strap buckle apparatus linking to said notebook computer and a strap, said strap buckle apparatus comprising:

a rotation hub;

a base, connected to said strap, said base having an opening;

a position pin, mounted on said rotation hub, said position pin facing toward said base; and a rotation plug, one end of said rotation plug being inserted into said lock hole to lock or unlock said strap buckle apparatus, the other end of said rotation plug being fixed to said rotation hub via said opening, wherein said rotation hub controls said rotation plug for locking or unlocking said lock hole.

2. The strap buckle apparatus of claim 1, further comprising a protection pad placed between said base and said rotation plug, said protection pad prevents from scratching the surface of said notebook computer.

3. The strap buckle apparatus of claim 2, wherein said protection pad is made of rubber.

4. A strap buckle apparatus fastened to a lock hole of a notebook computer, said strap buckle apparatus linking to said notebook computer and a strap, said strap buckle apparatus comprising:

a rotation hub;

a base, connected to said strap, said base having an opening; and a rotation plug, one end of said rotation plug being inserted into said lock hole to lock or unlock said strap buckle apparatus, the other end of said rotation plug being fixed to said rotation hub via said opening, wherein said rotation hub controls said rotation plug for locking or unlocking said lock hole, wherein said rotation hub further comprises an E-clip, to fasten said rotation plug to said rotation hub.

5. The strap buckle apparatus of claim 1, wherein said base further comprises a position groove to guide said position pin, two ends of said position groove being deeply carved.

6. The strap buckle apparatus of claim 1, wherein said base further comprises a strap holder to connect to said strap.

7. A strap buckle apparatus fastened to a lock hole of a notebook computer, said strap buckle apparatus linking to said notebook computer and a strap, said strap buckle apparatus comprising:

an E-clip;

a rotation hub;

a base, connected to said strap, said base having a first opening;

a protection pad, having a second opening; and a rotation plug, one end of said rotation plug being inserted into said lock hole to lock or unlock said strap buckle apparatus, the other end of said rotation plug being fixed to said rotation hub via said first and second openings, wherein said rotation hub controls said rotation plug for locking or unlocking said lock hole.

8. The strap buckle apparatus of claim 7, wherein said rotation hub further comprises a position pin, facing toward said base.

9. The strap buckle apparatus of claim 8, wherein said base further comprises a position groove to guide said position pin, two ends of said position groove being deeply carved.

10. The strap buckle apparatus of claim 7, wherein said base further comprises a strap holder connecting to said strap.

11. The strap buckle apparatus of claim 7, wherein said protection pad is made of rubber.

* * * * *